US011654319B1

(12) United States Patent
Coar

(10) Patent No.: US 11,654,319 B1
(45) Date of Patent: May 23, 2023

(54) TRANSPORTABLE PLAYPEN TOY COMBINATION

(71) Applicant: Tasha Coar, Tampa, FL (US)

(72) Inventor: Tasha Coar, Tampa, FL (US)

( * ) Notice: Subject to any disclaimer, the term of this patent is extended or adjusted under 35 U.S.C. 154(b) by 257 days.

(21) Appl. No.: 16/913,126

(22) Filed: Jun. 26, 2020

Related U.S. Application Data

(60) Provisional application No. 62/978,763, filed on Feb. 19, 2020.

(51) Int. Cl.
*A63B 5/11* (2006.01)
*A47D 13/06* (2006.01)

(52) U.S. Cl.
CPC ..... *A63B 5/11* (2013.01); *A47D 13/063* (2013.01)

(58) Field of Classification Search
CPC .... A47D 13/06; A47D 13/061; A47D 13/063; A47D 13/065; A47D 13/066; A47D 13/068; A63B 5/11
See application file for complete search history.

(56) References Cited

U.S. PATENT DOCUMENTS 2,563,915 A * 8/1951 Boisselier ..... A47D 13/063 5/98.3
7,909,703 B1 * 3/2011 Semrau ..... A63G 31/00 446/487
9,706,854 B1 * 7/2017 Zhou ..... A47D 7/04
10,881,933 B2 * 1/2021 Xiong ..... A63B 67/002
2005/0034232 A1 * 2/2005 Martin ..... A47D 7/04 5/93.1
2005/0166316 A1 * 8/2005 Gehr ..... A47D 13/063 5/99.1
2008/0016624 A1 * 1/2008 Osborn ..... A63H 33/006 5/658
2010/0162485 A1 * 7/2010 McCluskey ..... A47D 13/063 5/99.1
2016/0374481 A1 * 12/2016 Sclare ..... A47D 9/02 5/93.2
2017/0340939 A1 * 11/2017 Chen ..... A63B 67/10
2018/0214728 A1 * 8/2018 Ben Meir ..... E04H 4/0056
2019/0017654 A1 * 1/2019 Bearsch ..... F16M 11/38
2019/0168065 A1 * 6/2019 Brancatelli ..... B62B 9/26

* cited by examiner

*Primary Examiner* — David R Hare
*Assistant Examiner* — George Sun
(74) *Attorney, Agent, or Firm* — Gulf Coast Intellectual Property Group

(57) ABSTRACT

A portable playpen and toy combination apparatus that is operable to provide a first mode and second mode of use for at least one child. The present invention includes a frame having a top support member and a bottom support member. The frame includes a plurality of legs that are configured to be adjustable in length. A wall is secured to the frame and the height of the wall is adjustable changing the length of the legs. The interior volume includes a first bottom superposed a second bottom. The first bottom is releasably secured to the second bottom. The first bottom is a cushioned surface and the second bottom is a woven polypropylene material configured to provide a rebounding force. The frame further has secured to the top support member an engagement member wherein the engagement member is configured to movably traverse along the top support member.

5 Claims, 3 Drawing Sheets

TRANSPORTABLE PLAYPEN TOY COMBINATION

PRIORITY UNDER 35 U.S.C SECTION 119(E) & 37 C.F.R. SECTION 1.78

This nonprovisional application claims priority based upon the following prior U.S. Provisional Patent Application entitled: Transportable Playpen Toy Combination, Application No. 62/978,763 filed Feb. 19, 2020, in the name of Tasha Coar, which is hereby incorporated by reference for all purposes.

FIELD OF THE INVENTION

The present invention relates generally to children's apparatus, more specifically but not by way of limitation, a combined children's playpen and toy wherein the present invention provide an apparatus that is operable to provide a retention area for a small child as well as provide a structure to engage in play.

BACKGROUND

As is known in the art, small children typically require a significant amount of supervision and interaction. Young children cannot be left unattended for safety reasons and most young children have high activity levels. A common item that is known in the art for maintaining a safe environment for a small child is a playpen. Playpens are typically foldable so as to be easily transported and rapidly deployed. A conventional playpen is square in shape and includes a bottom having four walls defining the perimeter edge and operable to maintain a child within the interior volume thereof. The walls of a conventional playpen are typically a mesh type of material with the bottom being a softer material. These conventional playpens are static apparatus ensuing the setup thereof and provide a safe environment for a small children to play.

While conventional playpens provide a safe enclosed environment for small children, they do not provide any objects integrated therewith to facilitate interaction with a child. When placed in a playpen, most caretakers will place a toy within the playpen for the child to engage while disposed in the playpen. If a child does not have a toy placed within the playpen, there are no features of a conventional playpen configured to provide engagement for the child. Additionally, conventional playpens are typically utilized to provide a restricted area to retain small children when in settings that may or may not be child proofed. As young children typically require active engagement, these conventional playpens are deficient in providing any elements other than an area to place a child therein for safety or other reasons.

It is intended within the scope of the present invention to provide an apparatus that provides various elements in a combined apparatus wherein the apparatus of the present invention functions as a playpen but also provides numerous elements for a child to engage and play therewith.

SUMMARY OF THE INVENTION

It is the object of the present invention to provide an apparatus for a young child wherein the apparatus functions to combine the functionality of a playpen while additionally provide elements to engage and entertain a child wherein the present invention includes a body having a bottom and walls defining an interior volume.

Another object of the present invention is to provide a transportable apparatus for a child that functions as a retention area and is further configurable to be engaged as a toy wherein the body of the present invention can be configured as a playpen in a first mode.

A further object of the present invention is to provide an apparatus for a young child wherein the apparatus functions to combine the functionality of a playpen while additionally provide elements to engage and entertain a child wherein the present invention can be configured as a trampoline in a second mode.

Still another object of the present invention is to provide a transportable apparatus for a child that functions as a retention area and is further configurable to be engaged as a toy wherein the body of the present invention can be configured as a merry go-round in a third mode.

An additional object of the present invention is to provide an apparatus for a young child wherein the apparatus functions to combine the functionality of a playpen while additionally provide elements to engage and entertain a child wherein the bottom of the body of the present invention includes a padded cushion that is removable.

Yet a further object of the present invention is to provide a transportable apparatus for a child that functions as a retention area and is further configurable to be engaged as a toy wherein a trampoline spring surface is underneath the padded cushion.

Another object of the present invention is to provide an apparatus for a young child wherein the apparatus functions to combine the functionality of a playpen while additionally provide elements to engage and entertain a child wherein the padded cushion is releasably secured with a zipper or similar fastener.

An alternate object of the present invention is to provide a transportable apparatus for a child that functions as a retention area and is further configurable to be engaged as a toy wherein the interior volume further includes safety padding for use during the second mode wherein a child disposed therein is utilizing the trampoline surface.

Still a further object of the present invention is to provide an apparatus for a young child wherein the apparatus functions to combine the functionality of a playpen while additionally provide elements to engage and entertain a child wherein the body member is supported by adjustable legs.

An additional object of the present invention is to provide a transportable apparatus for a child that functions as a retention area and is further configurable to be engaged as a toy wherein the present invention further includes at least one rope for climbing thereon.

A further object of the present invention is to provide an apparatus for a young child wherein the apparatus functions to combine the functionality of a playpen while additionally provide elements to engage and entertain a child wherein in a preferred size the body is eight feet in diameter and up to six feet in height.

An alternative objective of the present invention is to provide a transportable apparatus for a child that functions as a retention area and is further configurable to be engaged as a toy wherein the net walls of the present invention include engagement elements such as but not limited to shapes and numbers.

Another object of the present invention is to provide an apparatus for a young child wherein the apparatus functions to combine the functionality of a playpen while additionally provide elements to engage and entertain a child wherein the body is anchor with portable weights to ensure stability thereof during use.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
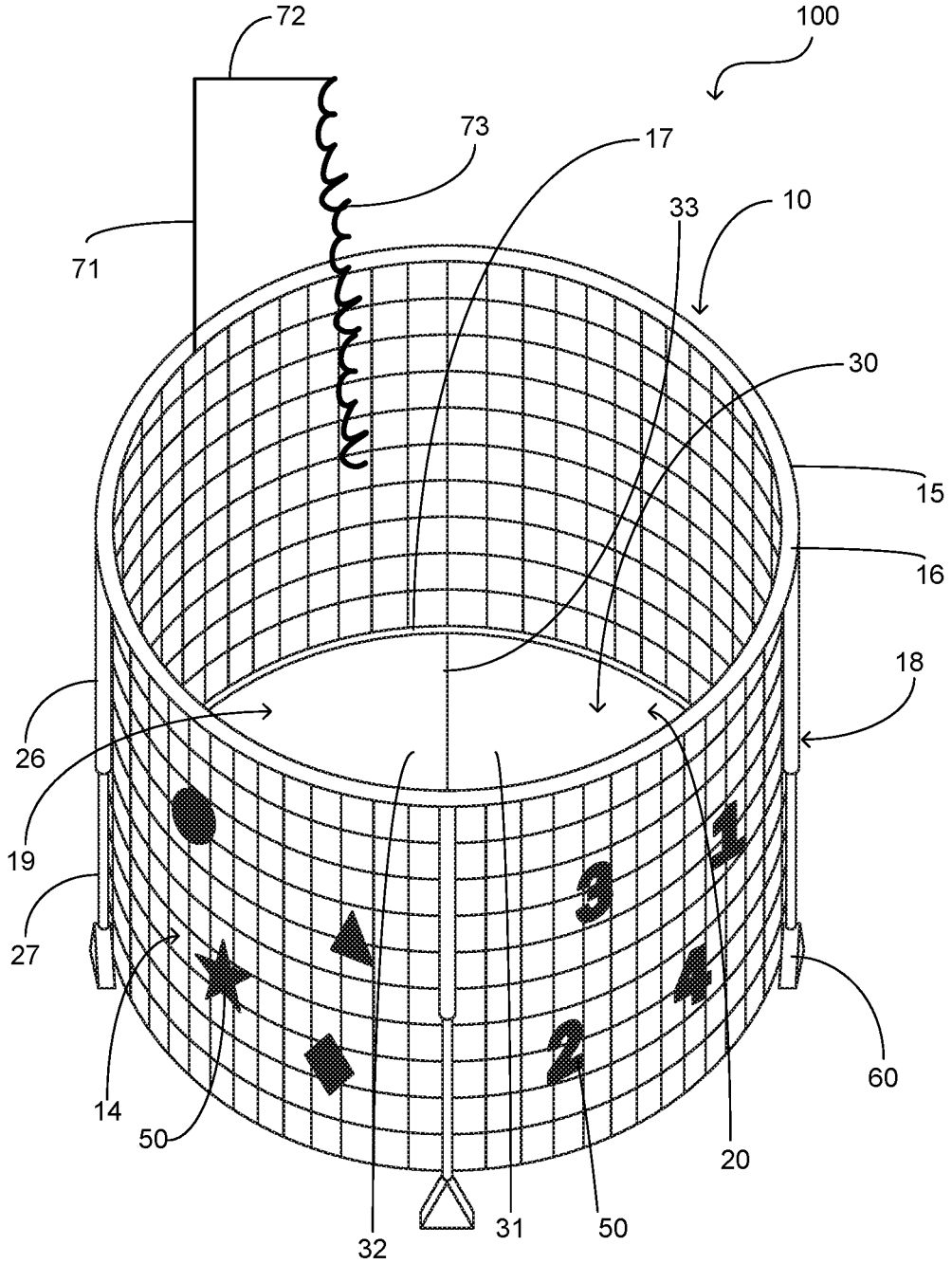
FIG. 1 is a perspective view of the present invention.
Figure 2:
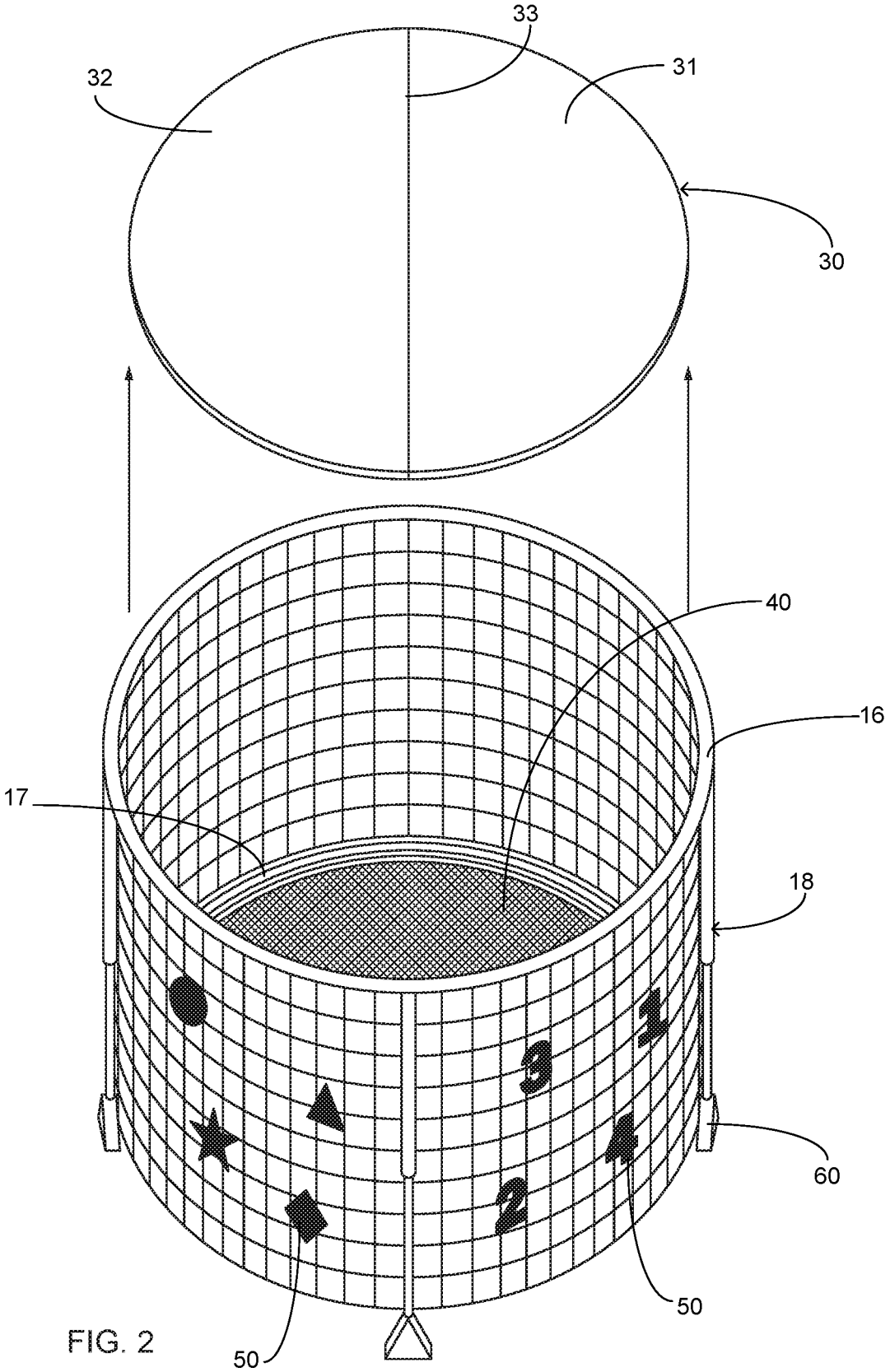
FIG. 2 is a perspective view of the present invention with the first bottom surface removed.

Referring now to the drawings submitted herewith, wherein various elements depicted therein are not necessarily drawn to scale and wherein through the views and figures like elements are referenced with identical reference numerals, there is illustrated a portable playpen and toy apparatus 100 constructed according to the principles of the present invention An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Now referring to the Figures submitted as a part hereof, the portable playpen and toy apparatus 100 includes a body 10. The body 10 includes a frame 15 wherein the frame 15 includes a top support member 16, a bottom support member 17 and a plurality of leg members 18. The aforementioned elements of the frame 15 are configured to define an interior volume 19 wherein the interior volume 19 has an opening 20 distal to the bottom member 17. The frame 15 further includes a wall 14 wherein the wall 14 inhibits egression of a child disposed in the interior volume 19. In a preferred embodiment, the wall 14 extends intermediate the top support member 16 and bottom support member 17 and is manufactured from a material such as but not limited to nylon mesh. While the wall 14 is manufactured from nylon mesh in a preferred embodiment, it should be understood within the scope of the present invention that the wall 14 could be manufactured from alternate materials.

The top support member 16 and bottom support member 17 are annular in shape and are manufactured from a suitable lightweight, rigid material such as but not limited to metal or plastic. The bottom support member 17 and top support member 16 are operably coupled with the plurality of legs 18. While the top support member 16 and bottom support member 17 are annular in shape in the preferred embodiment, it is contemplated within the scope of the present invention that the top support member 16 and bottom support member 17 could be formed in alternate shapes such as but not limited to square. While no particular size of the portable playpen and toy apparatus 100 is required, good results have been achieved having a frame 15 that is approximately eight feet in diameter.

The leg members 18 are circumferentially disposed on the frame 15 and are comprised of a first portion 26 and second portion 27. The second portion 27 is slidably coupled with the first portion 26 so as to facilitate the ability to adjust the overall height of the frame 15 and further provide assistance in reducing the size of the portable playpen and toy apparatus 100 so as to be suitable for transportation. The second portion 27 is movably coupled to the first portion 26 utilizing conventional techniques such as but not limited to spring pins and it is contemplated within the scope of the present invention that the first portion 26 and second portion could be movably coupled utilizing various suitable techniques. The first portion 26 and second portion 27 are operable to change the height of the wall 14 during alternate modes of use. During the second mode of use wherein the first bottom 30 is removed, it is desirable to have the height of the wall greater. While in a preferred embodiment the portable playpen and toy apparatus 100 has four leg members 18, it is contemplated within the scope of the present invention that the portable playpen and toy apparatus 100 could have more or less than four leg members 18. The leg members 18 are secured to the top support member 16 and bottom support member 17 utilizing suitable techniques that can either be permanent or releasable.

The portable playpen and toy apparatus 100 includes a first bottom 30 that is present proximate the bottom support member 17. The first bottom 30 includes a first segment 31 and a second segment 32 that are foldably coupled at seam 33. The first bottom 30 is a firm surface having a cushion that is capable of supporting at least one child superposed thereon and is utilized in the first mode of the portable playpen and toy apparatus 100 wherein at least one child can be disposed within the interior volume 19 and contained by the wall 14. The first bottom 30 is releasably disposed within the interior volume 19 so as to be removed to provide access to the second bottom 40. The second bottom 40 is underneath the first bottom 30 and is exposed for use ensuing removal of the first bottom 30. The second bottom 40 is manufactured from a woven polypropylene material and is spring mounted (not particularly illustrated herein) to the bottom support member 17. The second bottom 40 provides a second mode of functional use for the portable playpen and toy apparatus 100 wherein a child disposed on the second bottom 40 can jump on the second bottom 40 wherein the second bottom 40 provides a rebounding force so as to behave like a trampoline. It is contemplated within the scope of the present invention that the first bottom 30 and second bottom 40 are releasably secured utilizing a fastener such as but not limited to a zipper.

Secured to the wall 14 are a plurality of indicia and shape members 50. The indicia and shape members 50 are secured to the wall utilizing suitable techniques and it is contemplated within the scope of the present invention that the portable playpen and toy apparatus 100 could have a various quantities of indicia and shape members 50. The frame 15 further includes stabilization weights 60 that are operably coupled to the leg members 18 utilizing suitable fasteners. The stabilization weights 60 are secured to second portion 27 of leg members 18 and are releasably secured utilizing suitable fasteners and/or techniques. The stabilization weights 60 are deployed during use of the portable playpen and toy apparatus 100 when the child is using the second bottom 40 and can further be deployed during utilization of the first bottom 30.

The portable playpen and toy apparatus 100 further includes engagement member 70. Engagement member 70 is movably coupled to the top support member 16 so as to traverse therearound. The engagement member 70 includes vertical support member 71 and horizontal support member 72. The vertical support member 71 and horizontal support member 72 are operably coupled utilizing suitable durable techniques. The vertical support member 71 and horizontal support member 72 are manufactured from a suitable lightweight, rigid material such as but not limited to aluminum. Secured to the horizontal support member 72 distal to the vertical support member 71 is rope member 73. Rope member 73 is manufactured from a cotton or nylon rope braid and is configured to extend downward into the interior volume 19 past the opening 20 so as to be reachable by a child disposed within the interior volume 19. In use, a child can engage the rope member 73 and traverse in a circular pattern while maintaining engagement therewith as the engagement member 70 is movably coupled to the top support member 16 and will circumferentially traverse around the frame 15. It should be understood within the scope of the present invention that the engagement member 70 can be removed from the portable playpen and toy apparatus 100 in order during movement of the portable playpen and toy apparatus 100.

Figure 3:
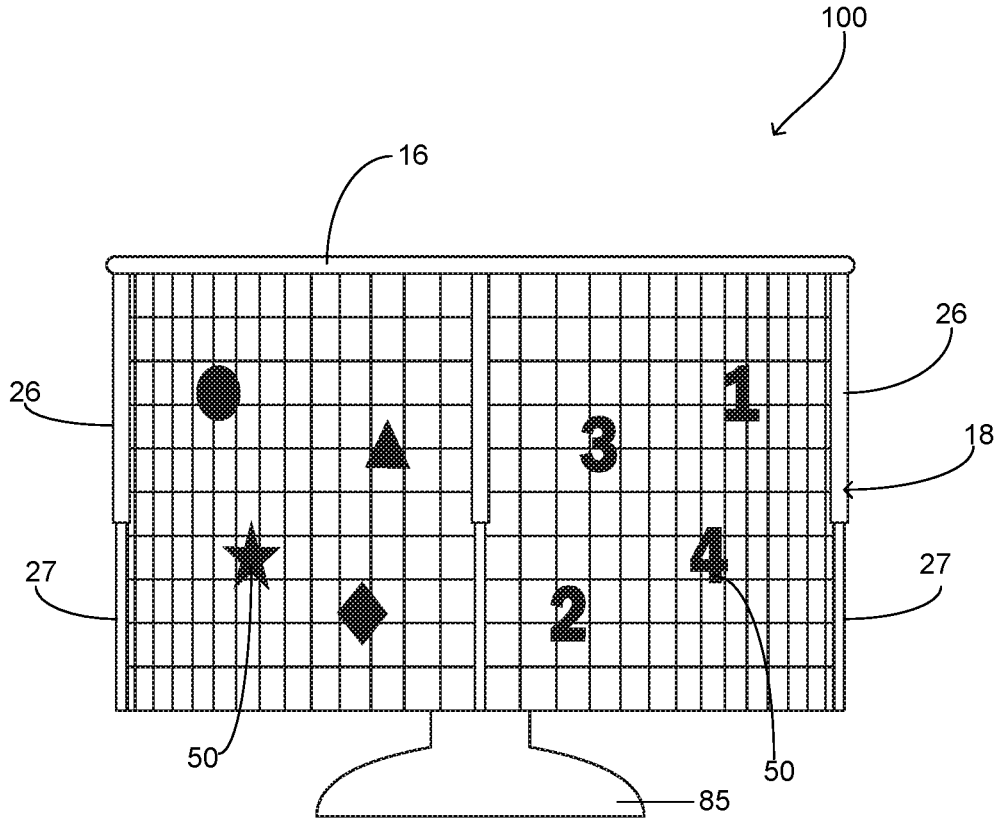
FIG. 3 is a side view of the present invention.

Referring now to FIG. 3 herein the portable playpen and toy apparatus 100 includes a rotational base 85 that is operable to provide a third mode of utilization thereof. The rotational base 85 is operably coupled to the frame 15 utilizing suitable support members (not particularly illustrated herein) and is configured to facilitate the rotational movement of the portable playpen and toy apparatus 100. During this mode of use the stabilization weights 60 are removed from the leg members 18 and retracted upward so as to disengage the support surface on which the portable playpen and toy apparatus 100 is superposed. It is contemplated within the scope of the present invention that the rotational base 85 could be manual or include a motorized apparatus disposed therein that facilitates the rotational movement of the portable playpen and toy apparatus 100.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the claims.

What is claimed is:

1. A portable playpen and toy combination apparatus operable to have a first mode of use, a second mode of use and a third mode of use wherein the portable playpen and toy combination apparatus comprises:

a frame, said frame having a top support member, said top support member being annular in shape, said top support member having an upper edge and a lower edge said frame having a bottom support member, said bottom support member being annular in shape, said frame further having a plurality of legs being operably coupled intermediate said bottom support member and said top support member, said plurality of leg members being coupled to said lower edge of said top support member, said plurality of legs having stabilization weights coupled thereto during said first mode and said second mode, said frame further including a wall, said wall extending intermediate said top support member and said bottom support member, said wall defining an interior volume of the portable playpen and toy combination apparatus;

a first bottom, said first bottom being proximate the bottom support member, said first bottom being releasably disposed within said interior volume of said frame, said first bottom having a first segment and a second segment, said first segment and said second segment being foldably coupled;

a second bottom, wherein said second bottom is secured to said bottom support member, said second bottom having said first bottom superposed thereon, said second bottom configured to provide a rebounding force to a user jumping thereon;

an engagement member, said engagement member being movably coupled to said top support member and configured to completely circumferentially traverse along said top support member of said frame while maintaining constant engagement therewith, said engagement member including a vertical support member extending upward from said top support member, said engagement member further including a horizontal support member secured to said vertical support member distal to said top support member, said horizontal member having a rope member operably coupled thereto, said rope member extending downward from said horizontal member towards said interior volume of the portable playpen and toy combination apparatus, said rope member configured to be grabbed by a child disposed in said interior volume; and wherein the portable playpen and toy combination apparatus in the first mode of use the first bottom is releasably secured superposed the second bottom so as to provide support for a child thereon.

2. The portable playpen and toy combination apparatus 1, wherein said second bottom is manufactured from a woven polypropylene material.

3. The portable playpen and toy combination apparatus 2, wherein the wall is manufactured from nylon mesh and further includes a plurality of indicia and shapes thereon.

4. The portable playpen and toy combination apparatus 3, wherein each of said plurality of legs includes a first portion and a second portion, said first portion and said second portion being movably coupled so as to provide alternate lengths of said plurality of legs.

5. The portable playpen and toy combination apparatus 4, wherein in said third mode of use said portable playpen and toy combination apparatus is operable to move in a rotational movement.

* * * * *